US010026545B2

(12) United States Patent
Miura et al.

(10) Patent No.: US 10,026,545 B2
(45) Date of Patent: Jul. 17, 2018

(54) WIRE CONNECTION STRUCTURE OF COIL DEVICE

(71) Applicant: U-SHIN LTD., Tokyo (JP)

(72) Inventors: Reiki Miura, Kure (JP); Shinichi Kuraishi, Kure (JP)

(73) Assignee: U-SHIN LTD., Tokyo (JP)

( * ) Notice: Subject to any disclaimer, the term of this patent is extended or adjusted under 35 U.S.C. 154(b) by 43 days.

(21) Appl. No.: 14/950,304

(22) Filed: Nov. 24, 2015

(65) Prior Publication Data

US 2016/0155591 A1 Jun. 2, 2016

(30) Foreign Application Priority Data

Nov. 28, 2014 (JP) ..... 2014-242374

(51) Int. Cl.

| | |
|---|---|
| ***H01F 5/02*** | (2006.01) |
| ***H01F 27/32*** | (2006.01) |
| *H01H 13/14* | (2006.01) |
| *H01H 13/52* | (2006.01) |

(52) U.S. Cl.

CPC ..... *H01F 27/325* (2013.01); *H01H 13/14* (2013.01); *H01H 13/52* (2013.01); *H01H 2219/036* (2013.01); *H01H 2219/062* (2013.01); *H01H 2231/026* (2013.01)

(58) Field of Classification Search

CPC ..... H01H 5/04; H01H 2005/043; H01H 2005/046; H01H 50/443; H01H 2050/446; H01H 336/192

USPC ..... 336/192

See application file for complete search history.

(56) References Cited

FOREIGN PATENT DOCUMENTS

JP 3952750 B2 8/2007

*Primary Examiner* — Ramon M Barrera

(74) *Attorney, Agent, or Firm* — Kratz, Quintos & Hanson, LLP

(57) ABSTRACT

A structure includes first and second terminals to fix a winding start portion and a winding end portion of a coil antenna formed by winding wire around a bobbin. The first terminal includes a fusing portion that connects the winding start portion to first and second entwining portions of the winding start portion. The second terminal includes a fusing portion that connects the winding end portion to first and second entwining portions of the winding end portion. Further, the entwining portions and the fusing portions of the first and second terminals are disposed orthogonal to an axial direction of a cylindrical portion of the bobbin and further are formed in the same direction.

6 Claims, 11 Drawing Sheets

WIRE CONNECTION STRUCTURE OF COIL DEVICE

BACKGROUND

Technical Field

The present invention relates to a wire connection structure in various kinds of coil devices, and for example, relates to a wire connection structure provided at a coil antenna as a coil device included in an engine start switch of a vehicle such as an automobile.

Related Art

There are various kinds of coil devices, but as an example thereof, a coil device of a solenoid valve (solenoid) included in an engine control mechanism of an automobile is illustrated in FIG. 11.

As illustrated, the coil device includes a coil 12 formed by winding copper wire around a cylindrical portion of a bobbin 11, and first and second terminals 13, 14 each having long narrow shape and integrally fixed to a bobbin flange 11*a*.

Further, in the coil device, first and second entwining portion 13*a*, 13*b* are formed at two places at an outer edge of the first terminal 13, and further a fusing portion (thermal caulking portion) 13*c* is formed between the first and second entwining portions 13*a*, 13*b*. In the same manner, first and second entwining portions 14*a*, 14*b* and a fusing portion 14*c* are provided at the second terminal 14.

In the coil 12 of the above-described coil device, a winding start portion 12*a* of the coil 12 is first entwined at the second entwining portion 13*b* of the first terminal 13, and subsequently passed through the fusing portion 13*c*, and then entwined at the first entwining portion 13*a*. After that, the winding start portion 12*a* is led to and wound around the cylindrical portion of the bobbin 11, thereby forming the coil 12.

Further, a winding end portion 12*b* of the coil 12 is led out from the bobbin 11 and entwined at the first entwining portion 14*a* of the second terminal 14, and subsequently passed through the fusing portion 14*c*, and then entwined at the second entwining portion 14*b*.

Further, the winding start portion 12*a* passed through the fusing portion 13*c* is fixed to the first terminal 13 by applying thermal caulking to the fusing portion 13*c* as illustrated in FIG. 12. In the same manner, the winding end portion 12*b* passed through the fusing portion 14*c* is fixed to the second terminal 14 by applying thermal caulking to the fusing portion 14*c*.

Meanwhile, a connecting portion 13*d* of the first terminal 13 and a connecting portion 14*d* of the second terminal 14 are electrically connected to a circuit board provided at a control mechanism.

SUMMARY

Related Prior Art

JP3952750B

According to the coil device described above, since the winding start portion 12*a* is passed through the fusing portion 13*c* and entwined at the first entwining portion 13*a* after having been entwined at the second entwining portion 13*b*, the winding start portion 12*a* is prevented from coming off from the fusing portion 13*c*. In the same manner, the winding end portion 12*b* is prevented from coming off from the fusing portion 14*c*. Therefore, wire connection of the winding start portion 12*a* and the winding end portion 12*b* is ensured.

Especially, there is an excellent effect that detachment of the fixed winding start portion 12*a* and winding end portion 12*b* and disconnection thereof are prevented even when vibration of an automobile or the like is transmitted.

However, in this coil device, the first and second entwining portions 13*a*, 13*b* of the first terminal 13 face the first and second entwining portions 14*a*, 14*b* of the second terminal 14 in a diametrically-opposed manner. Therefore, a nozzle must be inserted from a direction indicated by an arrow 15*a* (from the left direction in the drawing) to entwine the winding start portion 12*a* at the first and second entwining portions 13*a*, 13*b*. On the other hand, the nozzle must be inserted from a direction indicated by an arrow 15*b* (from the right direction in the drawing) to entwine the winding end portion 12*b* at the first and second entwining portions 14*a*, 14*b*.

Therefore, the inserting direction of the nozzle must be changed across 180 degrees between a step of entwining the winding start portion 12*a* at the first and second entwining portions 13*a*, 13*b* of the first terminal 13 and a step of entwining the winding end portion 12*b* at the first and second entwining portions 14*a*, 14*b* of the second terminal 14. Moreover, the inserting direction of the nozzle is to be changed again in a step of wire winding at the coil. Therefore, noise of an automatic wire winding machine and movement of a jig are increased, man-hours to perform wire winding at the terminals may be increased, and the automatic wire winding machine may be complex-structured.

Therefore, considering the above-described situations, the present invention is directed to providing a terminal structure of a coil device that can reduce noise and moving steps of the jig while performing wire winding at the coil terminals and wire winding at the coil and that can prevent the automatic wire winding machine from being complex-structured.

To achieve the above-described objects, as a first invention according to the present invention, proposed is a wire connection structure of a coil device including a pair of terminals that fixes a lead-out portion of a coil formed by winding wire around a cylindrical portion of a bobbin. In the wire connection structure, the bobbin includes an entwining portion that entwines the lead-out portion of the coil and a fusing portion that fixes the lead-out portion of the coil to the terminal, and the entwining portion and the fusing portion are disposed orthogonal to an axial direction of the cylindrical portion of the bobbin, and further formed in the same direction.

As a second invention, proposed is a wire connection structure of a coil device including: a first terminal that fixes a winding start portion of a coil formed by winding wire around a cylindrical portion of a bobbin; and a second terminal that fixes a winding end portion thereof. In the wire connection structure, the first terminal includes an entwining portion that entwines the winding start portion and a fusing portion that connects the winding start portion, the second terminal includes an entwining portion that entwines the winding end portion and a fusing portion that connects the winding end portion, and further the entwining portion and the fusing portion of the first terminal and the entwining portion and the fusing portion of the second terminal are disposed orthogonal to an axial direction of the cylindrical portion of the bobbin, and further formed in the same direction.

As a third invention, proposed is the wire connection structure of a coil device according to the second invention, in which the first terminal includes first and second entwining portions that entwine a winding start portion of the coil, and a fusing portion formed between the first and second entwining portions, and the second terminal includes first and second entwining portions that entwine a winding end portion of the coil, and a fusing portion formed between the first and second entwining portions.

As a fourth invention, proposed is the wire connection structure of a coil device according to the second or third invention, in which the first and second terminals each have plate-like body integrally formed with a bobbin flange, the first and second entwining portions are each formed by bending the plate-like body in a direction orthogonal to a flat portion, and the fusing portion is formed as a folded tongue piece that sandwiches and connects a winding start portion or a winding end portion in a space with the flat portion of the plate-like body.

As a fifth invention, provided is a wire connection structure of a coil device including: a first terminal that fixes a winding start portion of a coil formed by winding wire around a cylindrical portion of a bobbin; and a second terminal that fixes a winding end portion of the coil. In the wire connection structure, the bobbin includes an entwining portion that entwines the winding start portion and an entwining portion that entwines the winding end portion, the first terminal includes a fusing portion that connects the winding start portion, the second terminal includes a fusing portion that connects the winding end portion, and further the entwining portions of the bobbin and the fusing portions of the first and second terminals are disposed orthogonal to an axial direction of the cylindrical portion of the bobbin, and further formed in the same direction.

As a sixth invention, proposed is the wire connection structure of a coil device according to the fifth invention, in which the bobbin includes first and second entwining portions that are disposed in the vicinity of the first terminal and entwine the winding start portion of the coil, and first and second entwining portions that are disposed in the vicinity of the second terminal and entwine the winding end portion of the coil, the first terminal includes a fusing portion formed between the first and second entwining portions, and the second terminal includes a fusing portion formed between the first and second entwining portions.

As a seventh invention, proposed is the wire connection structure of a coil device according to the fifth or sixth invention, in which the first and second terminals each have a plate-like body integrally formed with a bobbin flange, the first and second entwining portions are formed integrally with the bobbin by resin molding, and the fusing portion is formed as a folded tongue piece that sandwiches and connects a winding start portion or a winding end portion in a space with a flat portion of the plate-like body.

As an eighth invention, proposed is the wire connection structure of a coil device according to any one of the second to seventh inventions, in which the coil is incorporated in a switch device that starts an engine of a vehicle, and the first and second terminals are electrically connected to a control circuit board of the switch device.

As described in the first and second inventions, the pair of terminals (first and second terminals) is provided in the coil device, and further each of the pair of terminals includes the entwining portions that fix the lead-out portions of the coil (winding start portion and winding end portion) and the fusing portion that connects the lead-out portion. Further, the entwining portions and the fusing portion are disposed orthogonal to the axial direction of the cylindrical portion of the bobbin and are formed in the same direction. Therefore, a nozzle can be inserted from the same direction at the time of entwining the lead-out portions of the coil at the entwining portions of the pair of terminals.

Therefore, automatic entwining of the lead-out portions of the coil and automatic wire winding operation at the coil can be easily performed, thereby reducing manufacturing steps of the coil device and also achieving to prevent a jig mechanism from being complex-structured.

Additionally, as described in the third invention, each of the first and second terminals respectively includes the fusing portion between the first and second entwining portions. Therefore, thermal caulking can be performed at the fusing portions in a state that the winding start portion and the winding end portion are being entwined at the first and second entwining portions.

Therefore, since wire connection processing is performed in the state that the lead-out portion of the coil is fixed, the winding start portion and the winding end portion of the coil are prevented from coming off from the fusing portion.

Further, as described in the fourth invention, since each of the first and second terminals can be formed by bending a piece of the plate-like body, man-hour for manufacturing these terminals can be reduced. Therefore, a coil device having the small number of components can be proposed.

Moreover, as described in the fifth to seventh inventions, since the entwining portion can be formed by resin molding, the terminal structure is simplified and portions needed to be bent is reduced. Therefore, man-hour for manufacturing can be reduced.

The eighth invention proposes the wire connection structure of the coil device characterized in being used as the coil antenna incorporated in the switch device to start the engine of the vehicle.

DETAILED DESCRIPTION

Next, an embodiment to implement the present invention as a coil antenna included in an engine start switch of a vehicle will be described with reference to the drawings.

Figure 1:
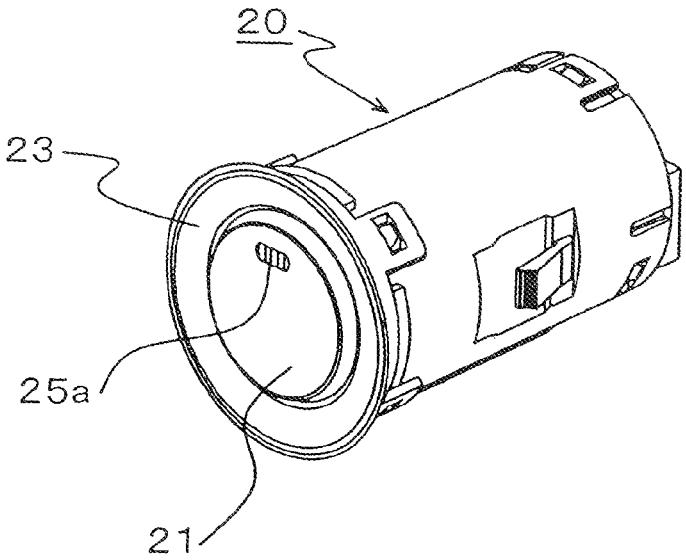
FIG. 1 is a perspective view illustrating an engine start switch of a vehicle in which a coil device having a wire connection structure according to the present invention is incorporated as a coil antenna.
Figure 2:
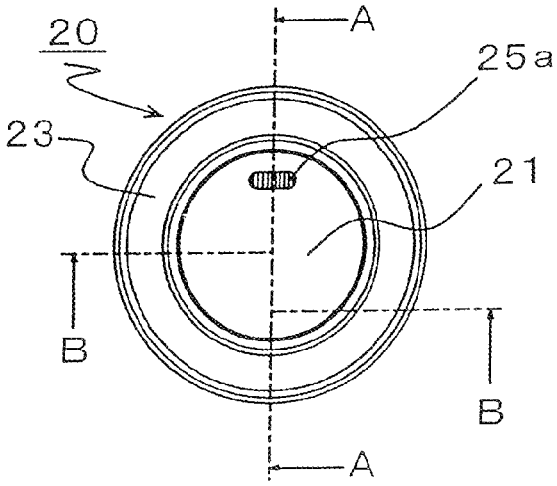
FIG. 2 is a front view of the engine start switch.
Figure 3:
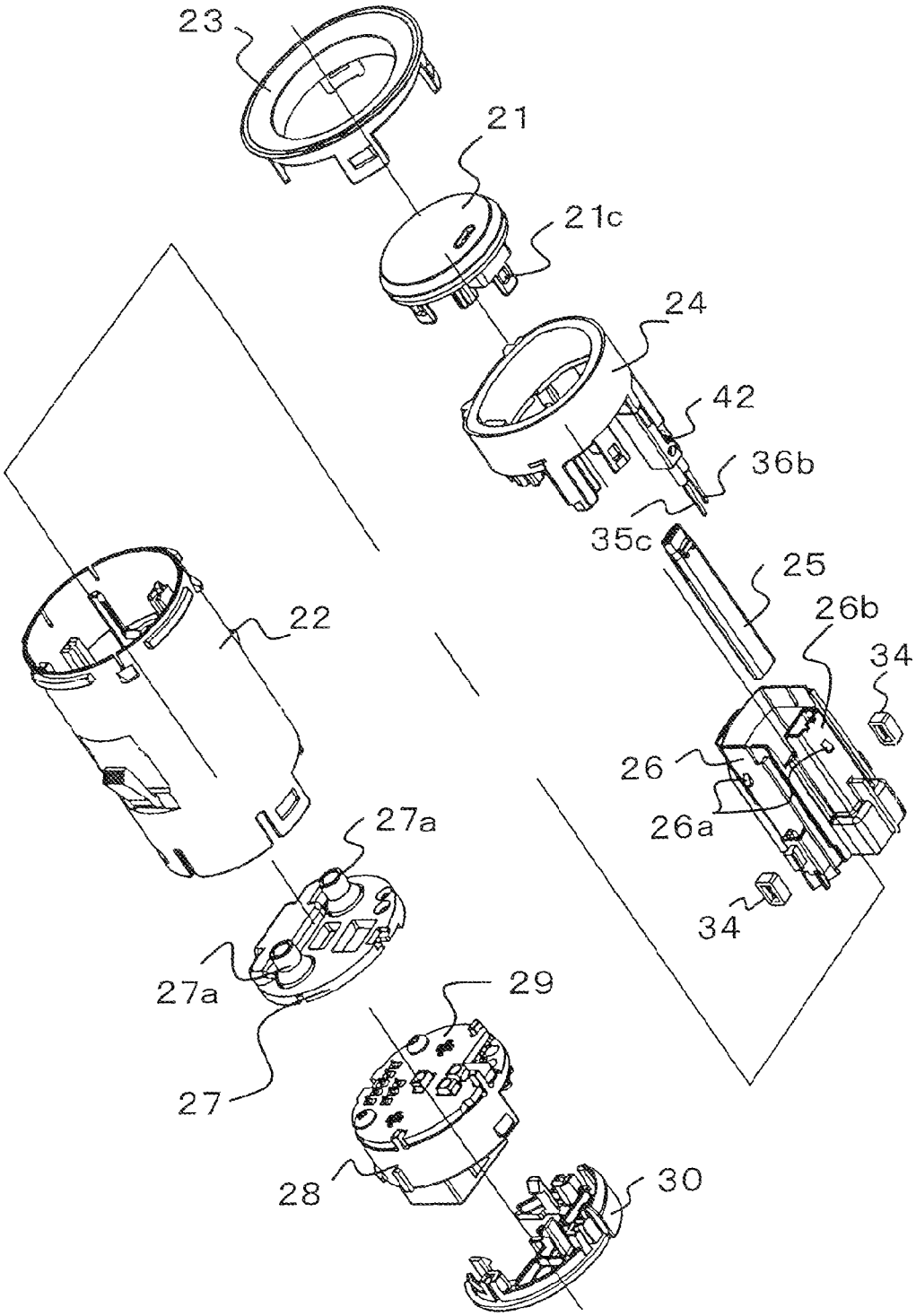
FIG. 3 is an exploded perspective view of the engine start switch illustrated in FIG. 1.
Figure 4:
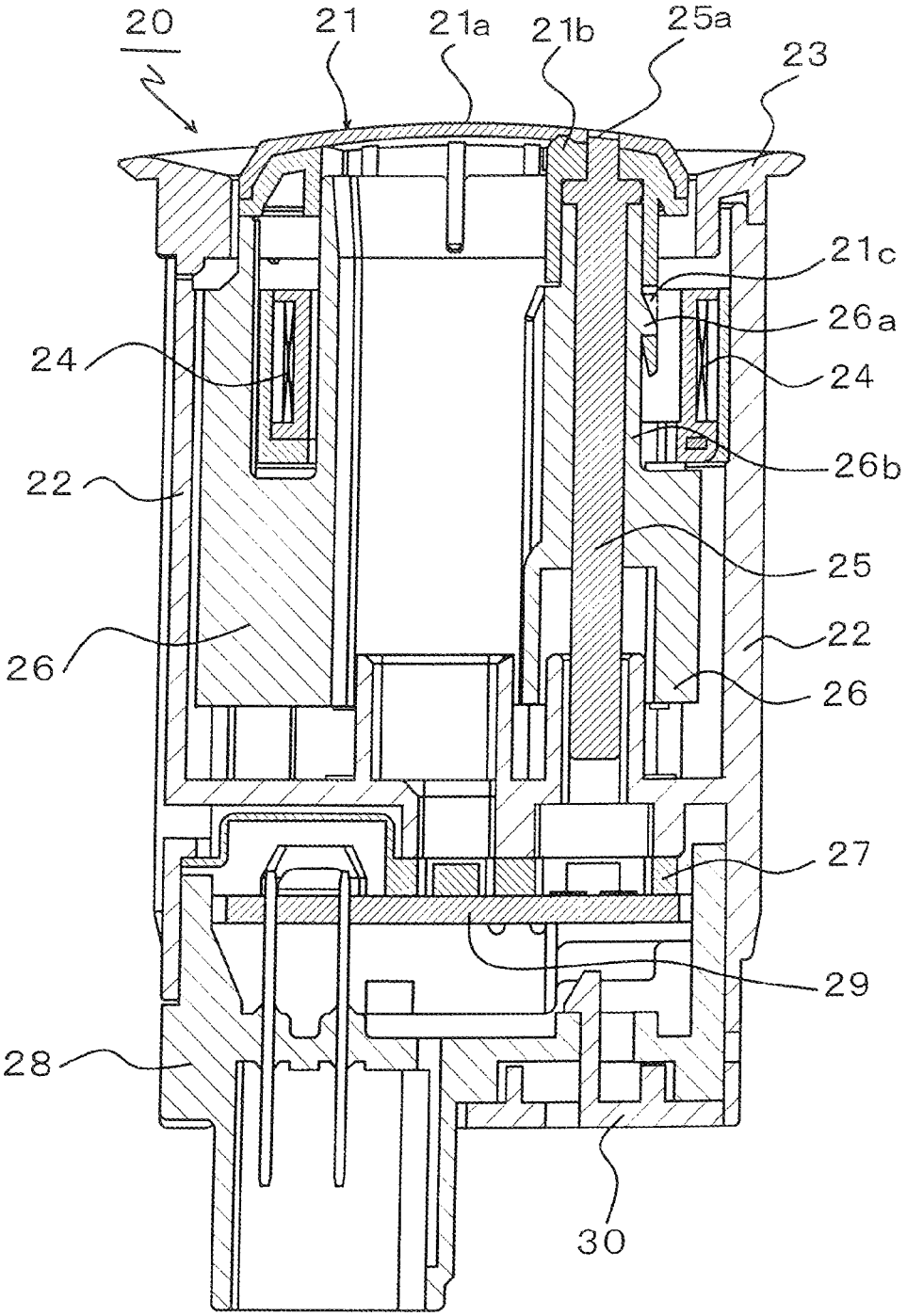
FIG. 4 is a cross-sectional view taken along a line A-A in FIG. 2.
Figure 5:
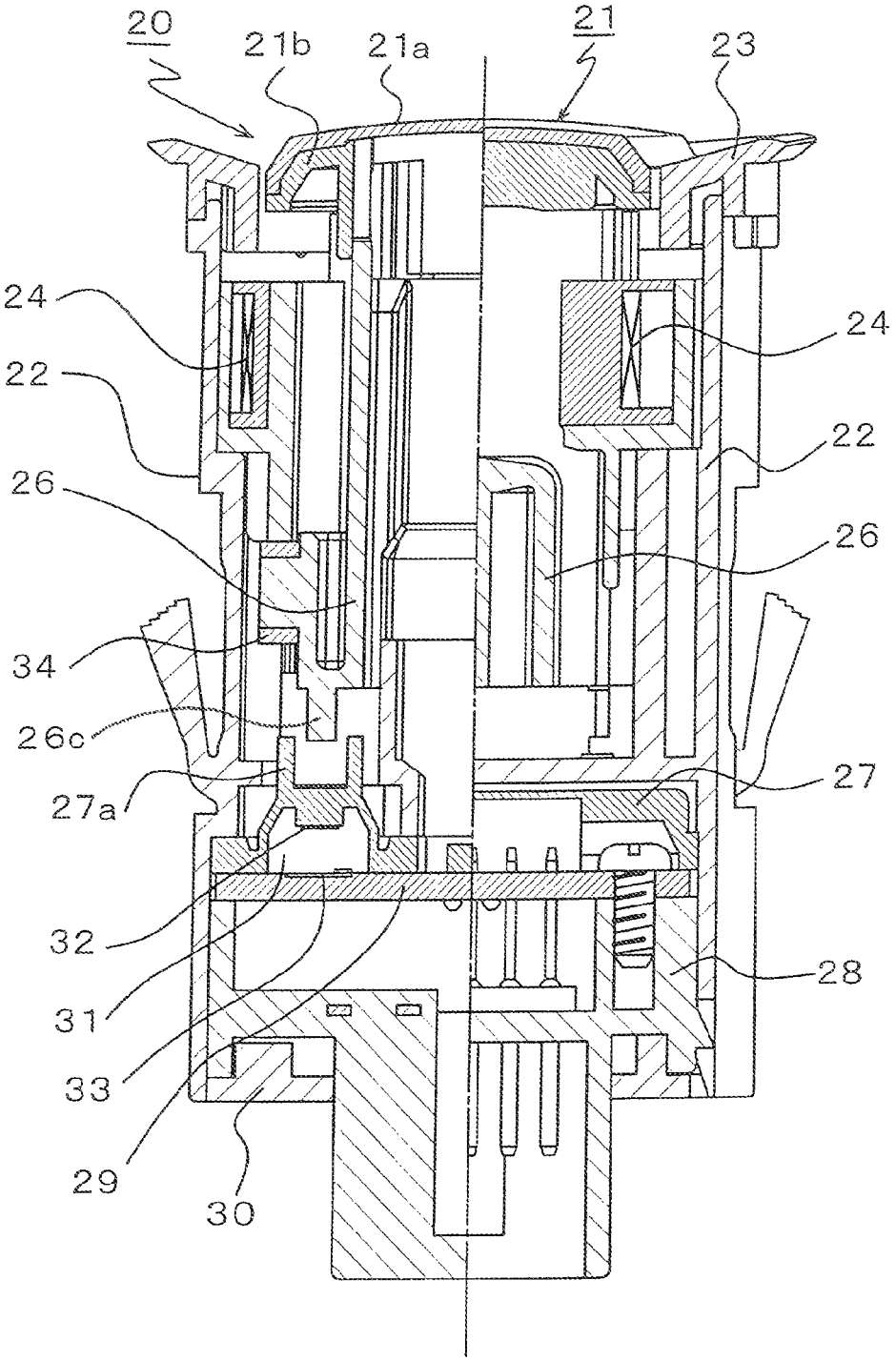
FIG. 5 is a cross-sectional view taken along a line B-B in FIG. 2.

FIG. 1 is a perspective view of the engine start switch, FIG. 2 is a front view of the engine start switch, FIG. 3 is an exploded perspective view of the engine start switch, FIG. 4 is a cross-sectional view taken along a line A-A in FIG. 2, and FIG. 5 is a cross-sectional view taken along a line B-B in FIG. 2.

An engine start switch 20 of the present embodiment is set at an instrument panel with an operation knob 21 exposed to an inner side of a vehicle.

Meanwhile, an indicator 25*a* is provided at the operation knob 21, and the indicator 25*a* lights up while the engine is in a running state and lights off while the engine is in a stop state.

As illustrated in FIG. 3, the engine start switch 20 includes a ring 23 that is fixed to a distal end portion of a case 22 and prevents the operation knob 21 from coming off, a coil antenna 24 fixed inside the case 22, an indicator lens 25, a slider 26, a rubber plate 27, a printed board (control circuit board) 29 provided at a terminal base 28, and a cover 30.

More specifically, as shown in the cross-sectional views of FIGS. 4 and 5, in the above engine start switch 20, the operation knob 21 is an integrated component formed of an operating portion 21*a* and a knob body 21*b*, and a locking portion 26*a* of the slider 26 is locked to a locking hole 21*c* provided at the knob body 21*b* such that the operation knob 21 and the slider 26 integrally move inside the case 22.

Further, the indicator lens 25 is provided inside a cylindrical portion 26*b* of the slider 26, and a distal end portion of the indicator lens 25 is formed as the indicator 25*a* in a manner exposed to a surface of the operation knob 21.

Additionally, a pressing portion 26*c* is provided at a lower portion of the slider 26, and a switch element 31 is moved by the pressing portion 26*c*.

More specifically, the rubber plate 27 includes a movable contact point 32 inside a conical elastic portion 27*a* at an integrally-formed cylindrical head portion, and further the switch element 31 is formed on the printed board 29 by providing a fixed contact point 33 opposing to the above-described movable contact point 32.

Note that two of the above-described same switch elements 31 are disposed in the present embodiment.

Meanwhile, the above-described slider 26 moves forward (moves downward in FIGS. 4 and 5) by pressing the operation knob 21, thereby turning ON the switch element 31. Further, when pressing the operation knob 21 is released, the slider 26 moves backward (moves upward in FIGS. 4 and 5) due to elasticity of the elastic portion 27*a* of the rubber plate 27. However, such upward and downward movement is stopped when a stop rubber 34 abuts on the coil antenna 24.

Meanwhile, the rubber plate 27 is sandwiched and held between the printed board 29 provided at the terminal base 28 and a stepped portion formed on an inner surface of the case 22. Further, the terminal base 28 is fixed inside the case 22 by the cover 30 fixed to a proximal end portion of the case 22.

The above-described engine start switch 20 presses the operation knob 21 and pushes the slider 26 into the case 22. By this, the elastic portion 27*a* of the rubber plate 27 is compressed by the pressing portion 26*c*. As a result, the movable contact point 32 contacts the fixed contact point 33, and the switch element 31 is turned ON.

Therefore, when the operation knob 21 is pressed while the engine is stopped, the engine can be started by turning ON the switch element 31.

When pressing the operation knob 21 is released after starting the engine, the slider 26 receives restoring force of the elastic portion 27*a* of the rubber plate 27 and moves backward. Therefore, the operation knob 21 is returned to the states illustrated in FIGS. 3 and 4.

By this, the movable contact point 32 separates from the fixed contact point 33, and the switch element 31 is turned OFF.

When the switch element 31 is turned ON by pressing the operation knob 21 while the engine is running, the engine can be stopped in response to an ON signal of the switch element 31.

On the other hand, the engine start switch 20 of the present embodiment includes the coil antenna 24 in order to support an immobilizer system.

As is widely known, in the immobilizer system, a startup signal (electromagnetic wave) transmitted from the coil antenna 24 is received by an electronic key held by an operator. Therefore, a transponder included in the electronic key outputs an ID code signal in response to the startup signal.

This ID code signal is received by the coil antenna 24.

By this, an ID code and a reference ID code are compared on the vehicle side, and when the ID codes are matched, the engine comes into a startable state.

In the case where the engine is thus turned into a startable state by the immobilizer system, the above-described engine start switch 20 can start the engine by pressing the operation knob 21.

Figure 6A:
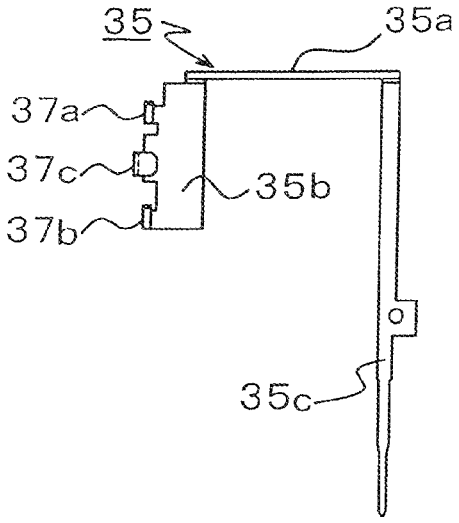
FIGS. 6A and 6B are front views of a pair of terminals provided at the coil antenna included in the engine start switch illustrated in FIG. 1.
Figure 6B:
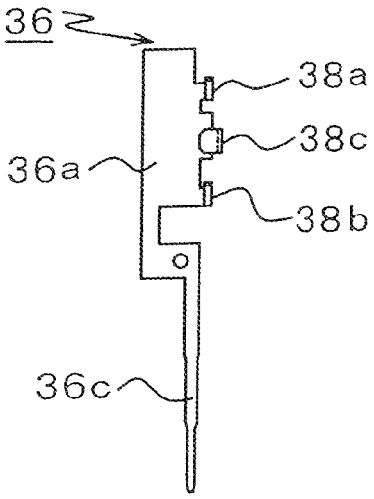

Next, the coil antenna 24 will be described in detail. FIGS. 6A and 6B are diagrams illustrating a first terminal 35 and a second terminal 36 provided at the coil antenna 24.

As illustrated, the first terminal 35 is formed of a metal plate in which an entwining plate portion 35*b* is formed at one end portion of an arc-shaped connection plate portion 35*a* and a connection terminal portion 35*c* is formed at the other end portion thereof respectively. The second terminal 36 is formed of a metal plate in which a connection terminal portion 36*b* is formed directly on an entwining plate portion 36*a*.

Additionally, first and second entwining portions 37*a*, 37*b* are formed at a predetermined interval on one side edge of the entwining plate portion 35*b* of the first terminal 35, and further a fusing portion 37*c* is provided between the entwining portions 37*a*, 37*b*.

More specifically, the entwining portions 37*a*, 37*b* are formed in a bending manner orthogonal to a plate surface of the entwining plate portion 35*b*, and further the fusing portion 37*c* is formed as a tongue piece folded back so as to be parallel to the plate surface of the entwining plate portion 35*b*.

In the same manner, first and second entwining portions 38*a*, 38*b* are formed at a predetermined interval on one side edge of the entwining plate portion 36*a* of the second terminal 36, and further a fusing portion 38*c* is provided between the entwining portions 38*a*, 38*b*.

More specifically, the entwining portions 38*a*, 38*b* are formed in a bending manner orthogonal to a plate surface of the entwining plate portion 36*a*, and further the fusing portion 38*c* is formed as a tongue piece folded back so as to be parallel to the plate surface of the entwining plate portion 36*a*.

Figure 7:
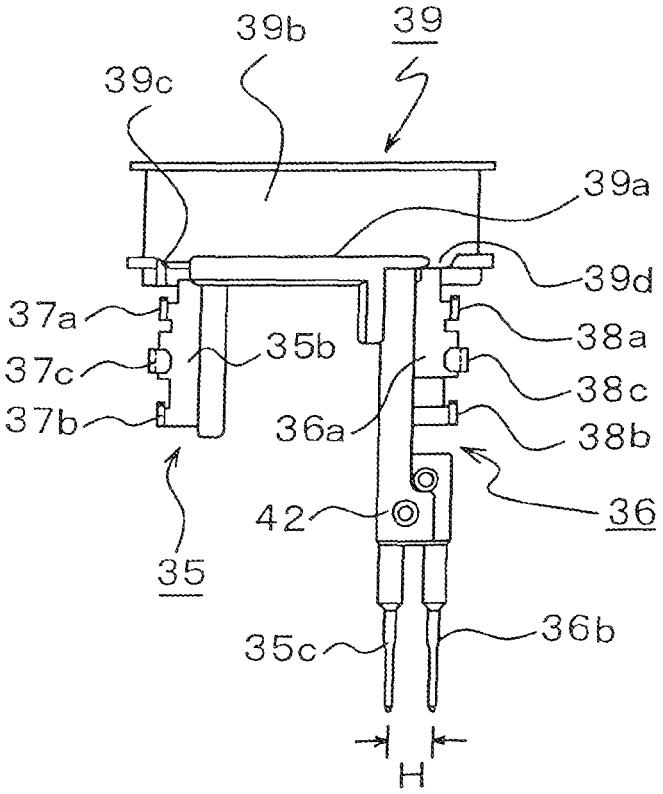
FIG. 7 is a front view of a bobbin, illustrating a state in which the pair of terminals illustrated in FIG. 6 is insert-molded in the bobbin.
Figure 8:
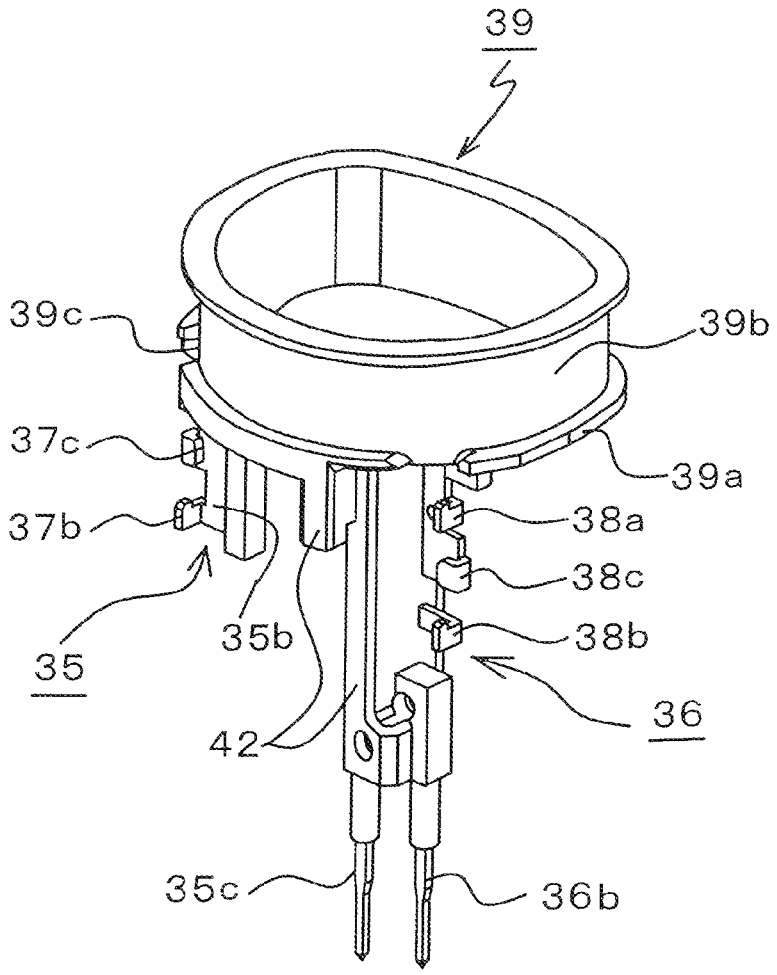
FIG. 8 is a perspective view of the bobbin illustrated in FIG. 7.

As illustrated in FIGS. 7 and 8, the above-described first and second terminals 35, 36 are insert-molded in the bobbin 39 having a substantially round shape, and are fixed integrally.

More specifically, an insert-molded resin portion 42 is provided on one side of a flange 39*a* of the bobbin 39, and the first and second terminals 35, 36 are formed in a projecting manner in an axial direction of a cylindrical portion 39*b* of the bobbin 39.

Further, the first and second terminals 35, 36 fixed in the above-described manner are set such that especially a predetermined interval H is kept between the connection terminal portion 35*c* and the connection terminal portion 36*b* (refer to FIG. 7), further the first entwining portion 37*a*, second entwining portion 37*b*, and fusing portion 37*c* of the first terminal 35, and the first entwining portion 38*a*, second entwining portion 38*b*, and fusing portion 38*c* of the second terminal 36 are disposed orthogonal to the axial direction of the cylindrical portion 39*b* of the bobbin 39 and set in the same direction (upward direction in the drawing paper of FIG. 7).

Figure 9:
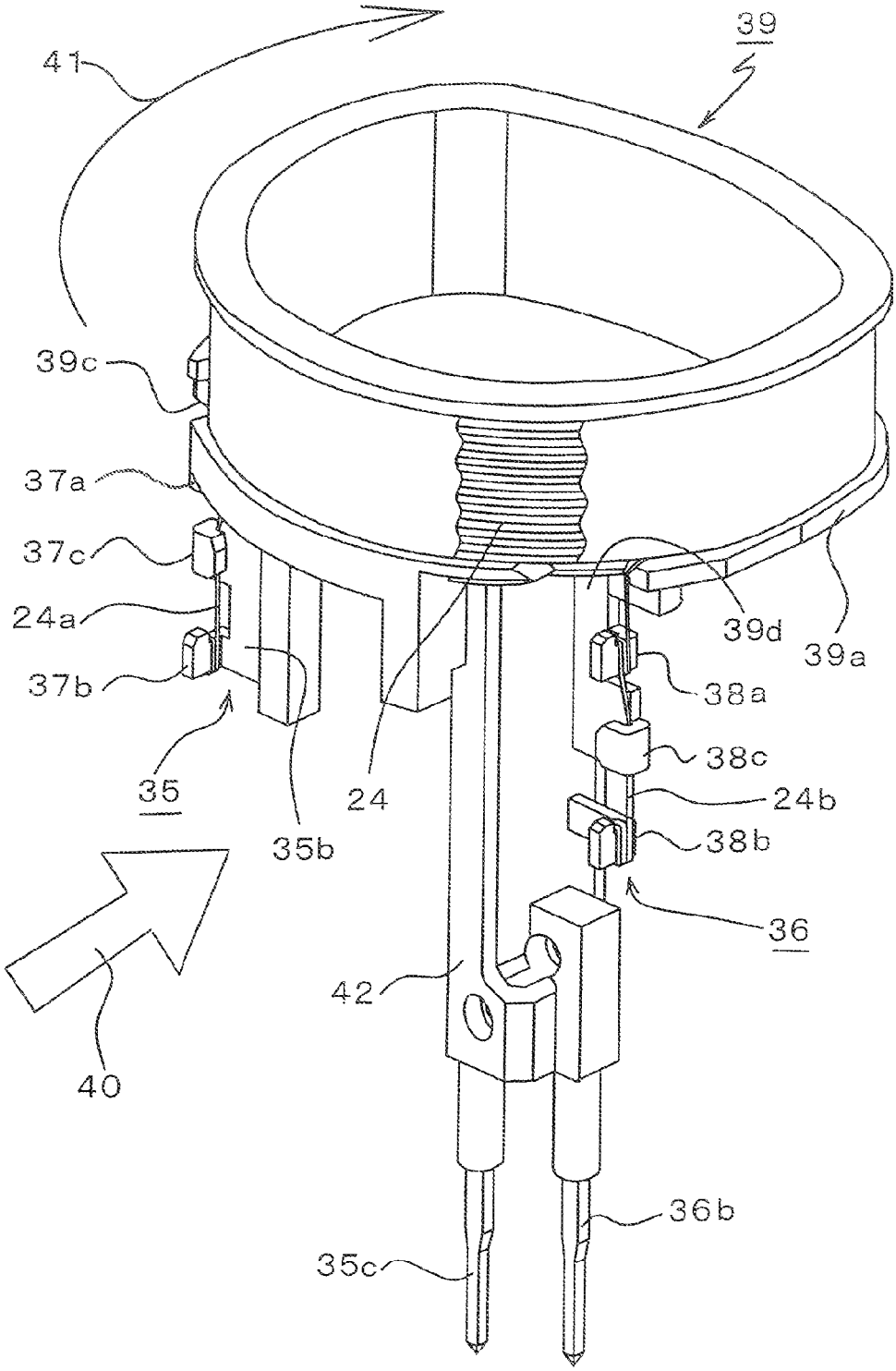
FIG. 9 is a perspective view of a coil antenna formed by winding copper wire around the bobbin illustrated in FIGS. 6 and 7.

As illustrated in FIG. 9, the coil antenna 24 is formed by winding copper wire around the above-described bobbin 39.

More specifically, before winding the copper wire around the bobbin 39, a winding start portion 24*a* that is a winding start point of the copper wire is entwined at the second entwining portion 37*b* of the first terminal 35, and then the winding start portion 24*a* is passed through the fusing portion 37*c* and further entwined at the first entwining portion 37*a*. Furthermore, the winding start portion 24*a* is passed through a bobbin cutout portion 39*c* and led to the cylindrical portion 39*b*, and copper wire following the winding start portion 24*a* is wound.

The copper wire wound around the bobbin 39 and forming the coil antenna 24 is led out from the bobbin cutout portion 39*d*, and this lead-out copper wire is entwined at the first entwining portion 38*a* of the second terminal 36 as a winding end portion 24*b*. Subsequently, the copper wire is passed through the fusing portion 38*c* and entwined at the second entwining portion 38*b*. Thus, a winding step is completed.

Meanwhile, the copper wire passed through the fusing portions 37*c*, 38*c* is applied with thermal caulking same as the related art, and connected to the first and second terminals 35, 36.

Further, note that passing the winding start portion 24*a* or the winding end portion 24*b* through the fusing portion 37*c* or 38*c* corresponds to passing the winding start portion 24*a* or the winding end portion 24*b* between the tongue piece of the fusing portion 37*c* or 38*c* and the plate surface of the entwining plate portion 35*b* or 36*a*.

An outer periphery of the coil antenna 24 wound as described above is covered with resin material and formed by resin molding.

Further, the connection terminal portions 35*c*, 36*b* of the first and second terminals 35, 36 are passed through the inside of the case 22 and electrically connected to the printed board 29.

In the coil antenna 24 having the above-described structure, the copper wire can be entwined at the respective entwining portions by inserting a nozzle from a side where the entwining portions 37*a*, 37*b* and the entwining portion 38*a*, 38*b* project as shown in FIG. 9.

More specifically, the nozzle is inserted from the side indicated by an arrow 40, the winding start portion 24*a* is entwined at the second entwining portion 37*b*, passed through the fusing portion 37*c*, and entwined at the first entwining portion 37*a*. After that, the nozzle is moved to a coil bobbin position without changing its orientation, and winding can be performed by rotating the bobbin 39 by a jig in a direction indicated by an arrow 41.

Further, after the coil antenna 24 is formed by winding the copper wire, the nozzle is moved to the second terminal 36 side without changing its orientation. Then, the winding end portion 24*b* is entwined at the first entwining portion 38*a*, passed through the fusing portion 38*c*, and entwined at the second entwining portion 38*b*.

Thus, the winding start portion and the winding end portion can be entwined without changing the inserting direction of the nozzle in manufacturing the coil antenna 24. Therefore, man-hours for wire winding can be reduced, and the jig can be prevented from being complex-structured.

Next, another embodiment of the present invention will be described.

Figure 10:
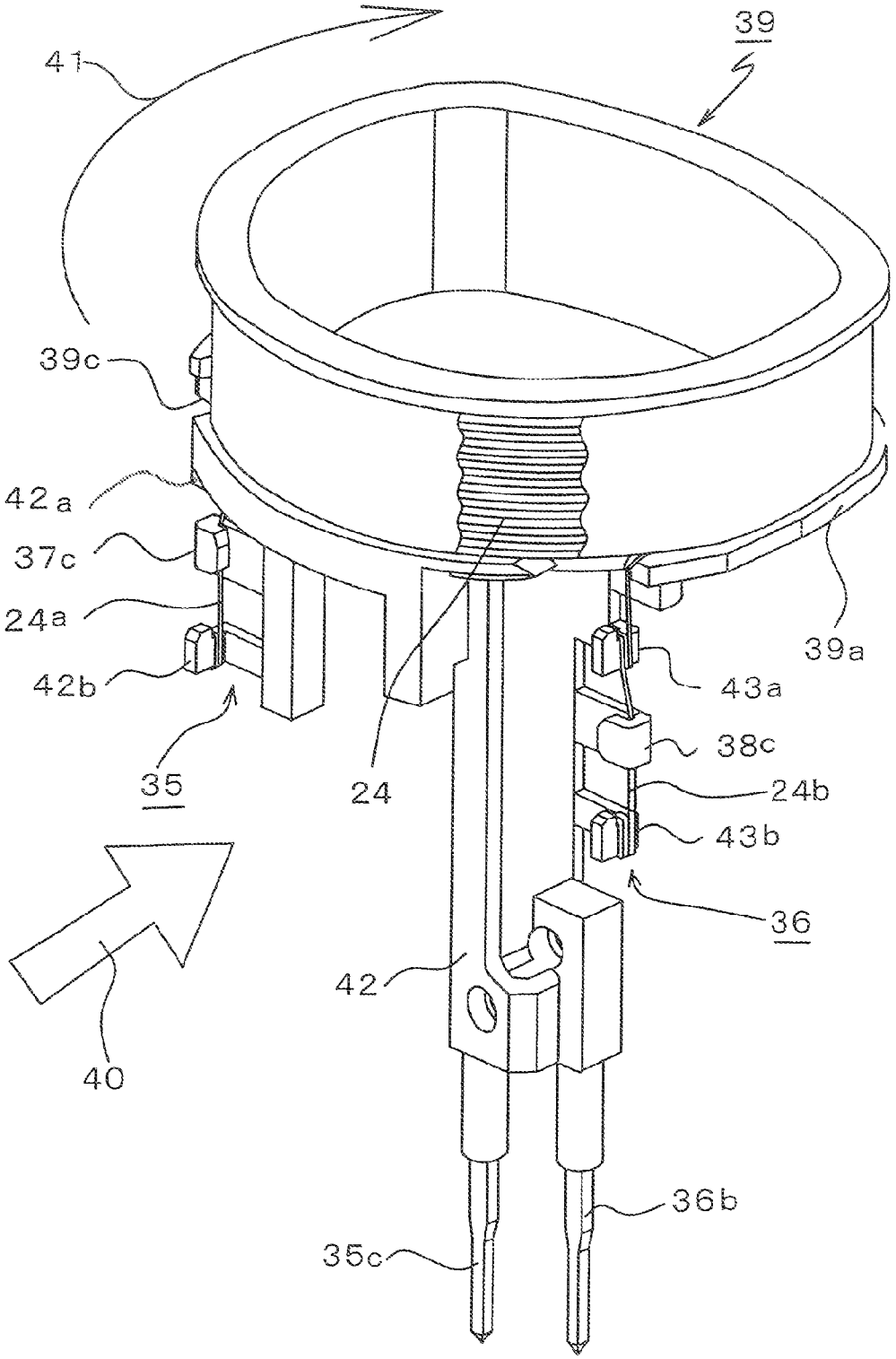
FIG. 10 is a perspective view of a coil antenna according to another embodiment.
Figure 11:
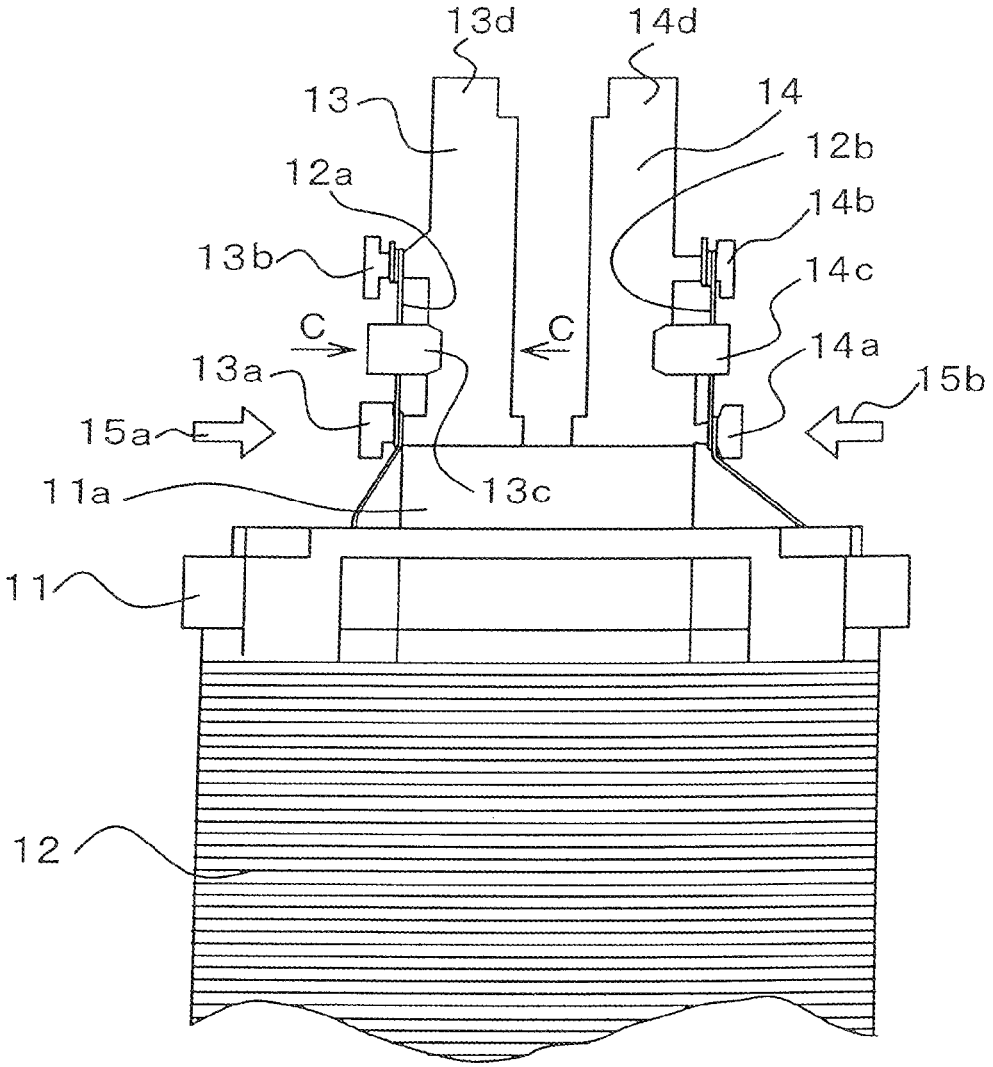
FIG. 11 is a front view of a partial cutout of a coil device illustrated as an exemplary related art.
Figure 12:
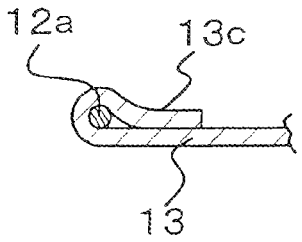
FIG. 12 is a cross-sectional view taken along a line C-C in FIG. 11.

FIG. 10 is a perspective view illustrating a coil antenna same as FIG. 9.

The present embodiment has a same structure as a first embodiment except for that a manufacturing method is different between first entwining portions 37*a*, 38*a* and second entwining portion 37*b*, 38*b*.

Therefore, portions having same functions as the above-described embodiment are denoted by same reference signs, and repetition of the same description will be omitted for convenience.

In the above-described embodiment, the first entwining portions 37*a*, 38*a* and the second entwining portions 37*b*, 38*b* are provided at first and second terminals 35, 36, but the present embodiment is characterized in that first entwining portions 42*a*, 43*a* and second entwining portions 42*b*, 43*b* are formed integrally with a bobbin 39 by resin molding.

For example, when an outer periphery of a wound coil antenna 24 is covered with resin material and formed by resin molding, the entwining portions and the bobbin are integrally formed and a fusing portion 37*c* of the first terminal 35 and a fusing portion 38*c* of the second terminal 36 are manufactured in a manner exposed from the resin.

The coil antenna 24 thus formed can have functions same as the above-described embodiment, and structures of the first terminal 35 and the second terminal 36 are simplified and portions needed to bent is reduced. Therefore, manufacturing steps can be reduced.

While the description has been given for the embodiments in which the present invention is implemented as the coil antenna included in the engine start switch, the second entwining portions 37*b*, 38*b* are not necessarily provided. Further, besides the above-described embodiments, the present invention can be implemented as a coil device such as a solenoid in the same manner.

The present invention is applicable as a coil antenna included in an engine start switch of an automobile and as other terminals such as a solenoid.

What is claimed is:

1. A wire connection structure of a coil device, comprising:

a first terminal configured to fix a winding start portion of a coil formed by winding wire around a cylindrical portion of a bobbin; and a second terminal configured to fix a winding end portion of the coil, wherein the first terminal includes an entwining portion configured to entwine the winding start portion, and a fusing portion configured to connect the winding start portion, the second terminal includes an entwining portion configured to entwine the winding end portion, and a fusing portion configured to connect the winding end portion, and wherein the entwining portion of the first terminal and the entwining portion of the second terminal are formed so that they extend out in the same direction orthogonal to an axial direction of the cylindrical portion of the bobbin.

2. The wire connection structure of a coil device according to claim 1, wherein the first terminal includes first and second entwining portions configured to entwine a winding start portion of the coil, and a fusing portion formed between the first and second entwining portions, and the second terminal includes first and second entwining portions configured to entwine a winding end portion of the coil, and a fusing portion formed between the first and second entwining portions.

3. The wire connection structure of a coil device according to claim 1, wherein the first and second terminals each have a plate-like body integrally formed with a bobbin flange, the first and second entwining portions are each formed by bending the plate-like body in a direction orthogonal to a flat portion, and the fusing portion is formed as a folded tongue piece configured to sandwich and connect a winding start portion or a winding end portion in a space with the flat portion of the plate-like body.

4. The wire connection structure of a coil device according to claim 2, wherein the first and second terminals each have plate-like body integrally formed with a bobbin flange, the first and second entwining portions are each formed by bending the plate-like body in a direction orthogonal to a flat portion, and the fusing portion is formed as a folded tongue piece configured to sandwich and connect a winding start portion or a winding end portion in a space with the flat portion of the plate-like body.

5. The wire connection structure of a coil device according to claim 1, wherein the coil is incorporated in a switch device to start an engine of a vehicle, and the first and second terminals are electrically connected to a control circuit board of the switch device.

6. A wire connection structure of a coil device according to claim 1, wherein the entwining portion and the fusing portion of the first terminal extend out in the same direction to one another, and the entwining portion and the fusing portion of the second terminal extend out in the same direction to one another.

* * * * *